United States Patent [19]

Saadi et al.

[11] Patent Number: 5,062,453

[45] Date of Patent: Nov. 5, 1991

[54] ON DEMAND SENSOR FLUSH VALVE

[75] Inventors: Robert E. Saadi; Allen R. Becker; Christopher J. Ball; John Steffan, all of Erie, Pa.

[73] Assignee: Zurn Industries, Inc., Erie, Pa.

[21] Appl. No.: 665,344

[22] Filed: Mar. 6, 1991

[51] Int. Cl.[5] ..... E03D 3/08; F16K 31/00

[52] U.S. Cl. ..... 137/624.11; 4/304; 251/129.04; 251/29; 251/30.04

[58] Field of Search ..... 251/129.04, 29, 40, 251/30.04; 4/304, 305; 137/624.11, 624.12

[56] References Cited

U.S. PATENT DOCUMENTS

| | | | |
|---|---|---|---|
| 1,756,263 | 4/1930 | Sloan . | |
| 1,858,470 | 5/1932 | Sloan . | |
| 2,438,207 | 3/1948 | Derby | 4/99 |
| 2,603,794 | 7/1952 | Bokser | 4/101 |
| 3,339,212 | 9/1967 | Atkins et al. | 4/100 |
| 3,434,164 | 3/1968 | Forbes | 4/100 |
| 3,462,769 | 8/1969 | Ichimori et al. | 4/100 |
| 3,670,167 | 6/1972 | Forbes | 250/221 |
| 3,695,288 | 10/1972 | Billeter et al. | 137/360 |
| 3,731,025 | 5/1973 | Filliung | 200/1.9 R |
| 3,778,023 | 12/1973 | Billeter | 251/30 |
| 3,863,196 | 1/1975 | Hilles | 340/1 R |
| 4,202,525 | 5/1980 | Govaer et al. | 251/40 |
| 4,309,781 | 1/1982 | Lissau | 4/304 |
| 4,327,891 | 5/1982 | Allen et al. | 251/38 |
| 4,624,017 | 11/1986 | Foletta | 4/304 |
| 4,667,350 | 5/1987 | Ikenaga et al. | 4/304 |
| 4,682,628 | 7/1987 | Hill | 251/129.04 |
| 4,707,867 | 11/1987 | Kawabe et al. | 4/313 |
| 4,742,583 | 5/1988 | Yoshida et al. | 4/313 |
| 4,793,588 | 12/1988 | Laverty, Jr. | 251/30 |
| 4,805,247 | 2/1989 | Laverty, Jr. | 4/304 |
| 4,826,129 | 5/1989 | Cher | 251/129.04 |
| 4,971,287 | 11/1990 | Shaw | 251/129.04 X |

*Primary Examiner*—Alan Cohan

*Attorney, Agent, or Firm*—Webb, Burden, Ziesenheim & Webb

[57] ABSTRACT

An on demand, non-contact sensor controlled flush valve actuation system includes a flush valve between a water supply and a plumbing fixture. An actuator for the flush valve includes a moveable piston in fluid communication with a control water inlet, with a control water conduit carrying water from the flush valve through a solenoid operated control valve to the actuator assembly. A radiation sensing/detecting unit generates a first control signal in response to the return reflection of infrared radiation. A timer receives the first control signal and, in response thereto, generates a second control signal of a predetermined duration which activates the solenoid. When the solenoid is activated, a portion of the pressurized supply water flows into the actuator assembly and against a piston therein, with the piston moving to operate a trip mechanism for the flush valve.

20 Claims, 3 Drawing Sheets

ON DEMAND SENSOR FLUSH VALVE

BACKGROUND OF THE INVENTION

1. Field Of The Invention

This invention relates to the operation of flush valves and, more particularly, to non-contact, sensor operated mechanisms for operating flush valves.

2. Description Of The Prior Art

The use of flush valves for controlling the flow of water to plumbing fixtures, particularly in public facilities, is well known. Such flush valves typically include a movable diaphragm which closes the water supply and is tripped by a handle operated trip mechanism. See, for example, U.S. Pat. Nos. 1,756,263, 1,858,470, 4,202,525 and 4,327,891. Push button arrangements for tripping diaphragm flush valves have also been developed. U.S. Pat. No. 3,695,288 and 3,778,023. All of these arrangements provide controlled, on demand flushing of the plumbing fixture through controlling the flush valve trip mechanism.

It has long been recognized that human contact with the handle, push button, or other device for tripping the flush valve is not particularly sanitary, especially in heavily used public restroom facilities. It has also been recognized that non-contact arrangements for tripping the flush valve are desirable. For example, U.S. Pat. No. 3,731,025 discloses an arrangement in which a breath operated disc connected to a switch arm is used to activate an electric solenoid or motor which moves an actuator rod to contact the flush valve trip mechanism. Although this arrangement provides a sanitary, non-contact method of operating the flush valve, the mechanism is quite delicate and the use of a person's breath to operate the switch is not generally acceptable to the public. The most common, non-contact method of activating a flush valve or the like is the use of a sensor operated system. See, for example, U.S. Pat. Nos. 2,438,207, 2,603,794, 3,339,212, 3,434,164, 3,462,769, 3,670,167, 3,863,196, 4,309,781, 4,624,017, 1,667,350, 4,707,867, 4,742,583, 4,793,588 and 4,805,247. These systems provide for automatic tripping of the flush valve by first detecting when a person is present at the plumbing fixture, then detecting when the person leaves the fixture, and then triggering the flush mechanism for the fixture. While these systems provide for a non-contact and sanitary flushing of the plumbing fixture, it does so at the expense of the user's direct control of the flush mechanism which is present in the handle and push button operated systems.

Accordingly, it is an object of the present invention to provide a system for controlling the operation of a flush valve which combines the non-contact, sanitary features of a sensor operated system in an on demand, user controlled flushing arrangement. It is a further object of the present invention to provide such an arrangement in a simple and inexpensive system which is reliable in operation.

SUMMARY OF THE INVENTION

Accordingly, we have developed an on demand, non-contact sensor controlled flush valve actuation system which includes a flush valve controlling the flow of water between a pressurized water supply and a plumbing fixture. The flush valve includes a trip mechanism therein. An actuator assembly is positioned within the flush valve and includes a moveable piston which is in fluid communication with a control water inlet. A control water conduit has one end connected to the flush valve and is in constant fluid communication with the pressurized water supply. A normally closed, solenoid operated control valve has an inlet port connected to the other end of the control water conduit and has an outlet port connected to the control water inlet of the actuator assembly. The system also includes a radiation generating and sensing unit which generates the first control signal in response to the return reflection of electromagnetic radiation generated therein. Finally, the system includes a timer which receives the first control signal and in response thereto generates a second control signal of a predetermined duration. The second control signal is supplied to and activates the solenoid operated control valve, which permits a portion of the pressurized supply water to flow into the control water inlet and against the piston. The piston then moves from the pressure of the supply water and moves the actuator assembly against the trip mechanism, thus opening the flush valve.

Preferably, the system includes an infrared radiation sensing unit. The actuator assembly can include an actuator rod which is moved by the piston against the trip mechanism, with the piston and actuator rod preferably an integral unit. The actuator rod can be held by and moved within a seal retaining unit having at least one water drain hole therethrough and a spring surrounding the actuator rod and extending between the seal retaining unit and the piston.

Preferably, the piston is cup-shaped and has its open portion directed toward the control water inlet. The piston can also include at least one water bleed hole therethrough. The timer is preferably a timing relay which includes a power-up feature such that no second control signal is generated when the electrical power is first supplied to the system. This insures that multiple plumbing fixtures are not inadvertently activated simultaneously when a multi-unit system is first connected to the electrical power. The predetermined delay for the timer is preferably about two seconds.

DESCRIPTION OF THE PREFERRED EMBODIMENT

Figure 1:
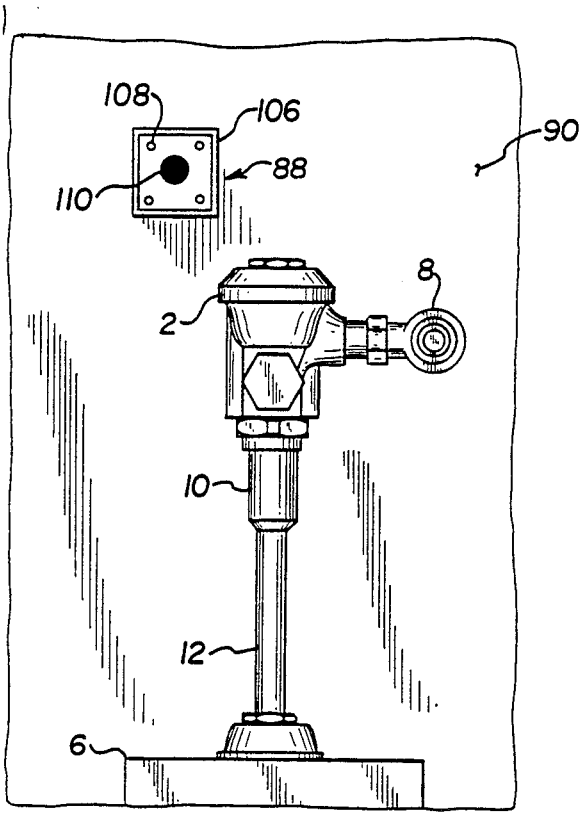
FIG. 1 is a front view of a flush valve including the on demand sensor control in accordance with the present invention.

An on demand, non-contact sensor controlled flush valve actuation system in accordance with the present invention is shown in FIGS. 1–5. A standard flush valve 2 is positioned between an inlet water supply pipe 4 and a plumbing fixture 6 which is to be supplied with water. A stop valve assembly 8 may be positioned between the inlet water supply pipe 4 and the flush valve 2. A vacuum breaker assembly 10, including a rigid insert 11 and a flexible rubber sleeve 13, is typically positioned downstream of the flush valve 2 and a flush tube 12 carries water from the flush valve 2 to the plumbing fixture 6.

Figure 4:
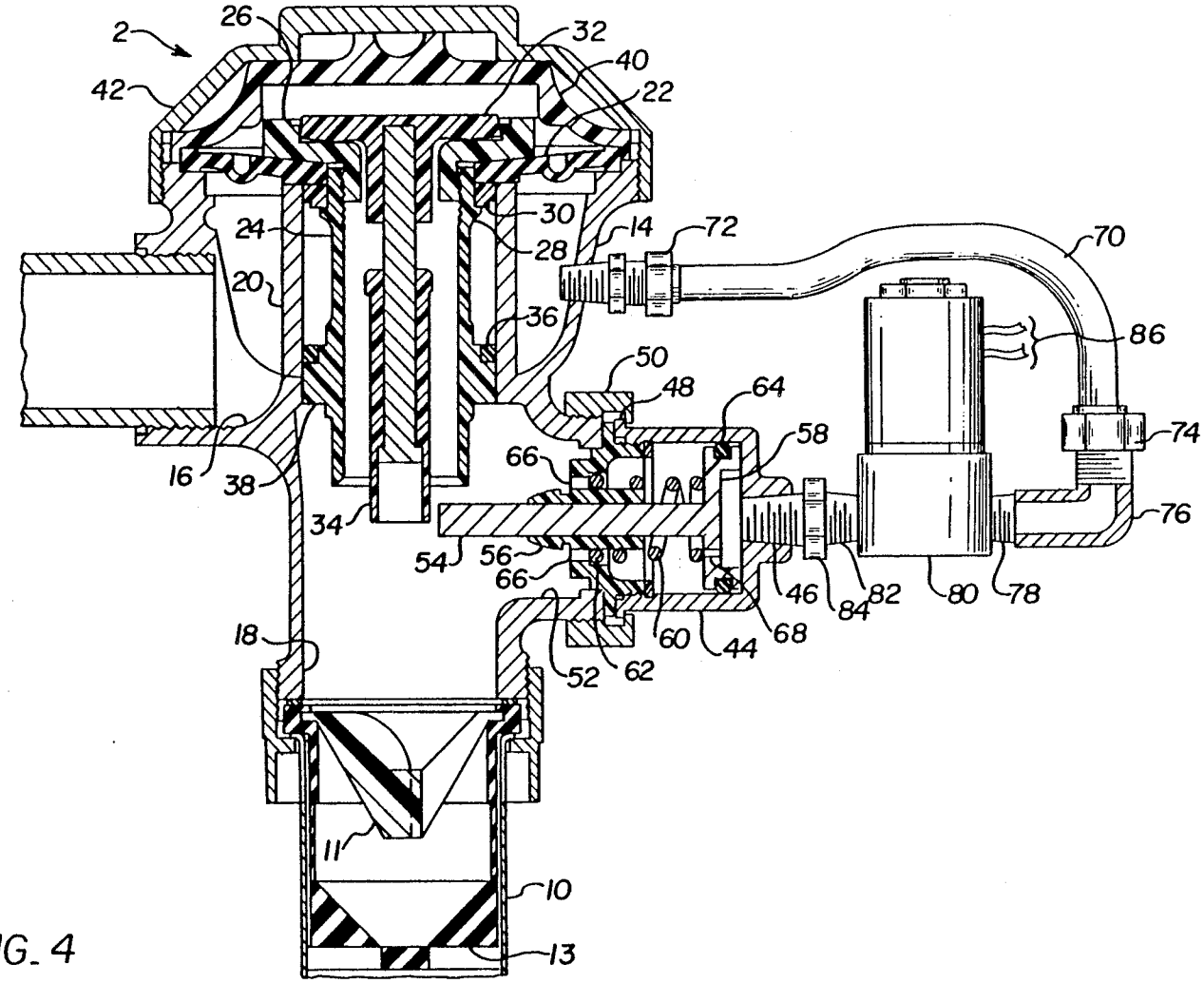
FIG. 4 is a section taken along lines IV—IV in FIG. 3, with the wall removed.

Referring particularly now to FIG. 4, the control arrangement of the present invention is shown in connection with a standard diaphragm operated flush valve 2. The flush valve 2 includes a valve body 14 having a water inlet opening 16 and a water outlet opening 18. An internal, upstanding barrel or throat 20 is positioned within the valve body 14 between the water inlet and outlet openings 16, 18, with the upper edge portion of the barrel 20 forming an annular main valve seat. The main valve member is a flexible, circular diaphragm 22 clamped to the upper end of a cylindrical slide 24 which extends downwardly within the upstanding barrel 20. The diaphragm 22 has a central opening through which a clamping disc 26 extends. A portion of the clamping disc 26 is threaded into the cylindrical slide 24 and clamps the diaphragm 22 therebetween. The upper end of the cylindrical slide 24 is provided with a shoulder or lip 28 which holds a flow ring 30 located immediately beneath the diaphragm 22.

The clamping disc 26 has a central opening which is closed by relief valve or trip mechanism 32 having an elongated stem 34 extending downwardly through the cylindrical slide 24 and beyond its lower end. A guide ring 36, provided around the cylindrical slide 24, is supported on a plurality of supports 38 integral therewith. A plastic cover 40 is positioned above and spaced from the diaphragm 22 and forms a pressure chamber above the diaphragm 22. The plastic cover 40 and diaphragm 22 are held in place by a metallic end cap cover 42 which is threaded onto the open top of the valve body 14. Typically, a small bypass opening (not shown) extends through the diaphragm 22 and permits water to fill the space between the plastic cover 40 and the diaphragm 22.

The operation of the above-discussed flush valve 2 is well known. The water pressure above and below the diaphragm 22 is equalized by the bypass opening therethrough and, thereby, the diaphragm 22 is held tightly against the valve seat of the upstanding barrel 20. When the trip mechanism is actuated, i.e., when the stem 34 attached to the relief valve 32 is tilted away from its normal, vertical alignment, the relief valve 32 will tilt away from sealing engagement with the clamping disc 26 and will relieve the pressure holding the diaphragm 22 in place. The pressure of the inlet water will then flex and lift the diaphragm 22 and permit the water to flow through the barrel 20 and out of the valve 2. Water flow through the bypass opening will reestablish the water pressure above the diaphragm 22 and gradually force the diaphragm 22 down into engagement with the valve seat on the barrel 20.

The actuator unit or assembly for the trip mechanism 32, 34 of the flush valve 2 is provided, as shown in FIG. 4, on one side of the valve body 14. The actuator assembly includes a cup-shaped, actuator housing 44 having a control water inlet 46 at its closed side. The other, open side of the actuator housing 44 has a shoulder 48 for engaging a coupling nut 50 which threadedly connects the actuator housing 44 to and in contact with an appropriate opening 52 through the side of the valve body 14 beneath the diaphragm 22 and barrel 20. An elongated actuator rod 54 is slidably carried by a seal retainer 56 which is supported by being clamped at its outer edges between the valve body 14 and the shoulder 48 of the actuator housing 44 by the coupling nut 50. One end of the actuator rod 54 is oriented toward the trip mechanism, particularly, toward the stem 34 attached to the relief valve 32. The other end of the actuator rod 54 is formed in an integral cup-shaped head or piston 58 which is oriented with its open end toward the water inlet 46 through the actuator housing 44. A restoring coil spring 60 for the piston 58 surrounds the actuator rod 54 and extends between an outer surface of the seal retainer 56 and the inner, flat surface of the piston 58. Preferably, the end of the spring 60 adjacent the retainer 56 is positioned within a recess 62 therein. A U-shaped groove is provided on the outer periphery of the piston 58 and carries therein a sealing O-ring 64. The seal retainer 56 has at least one drain hole 66 extending therethrough from the interior of the valve body 14 to the area within the actuator housing 44 between the seal retainer 56 and the piston 58. Similarly, at least one bleed hole 68 extends through the piston 58 between the interior of the actuator housing 44 and the cup-shaped depression of the piston 58 adjacent the water inlet 46.

A control water conduit or tube 70 has one end connected to the valve body 14 in fluid communication with the pressurized water therein. The control water tube 70 is preferably a length of high pressure, flexible nylon tubing. A compression fitting 72 extends through the valve body 14 in the area of the valve 2 surrounding the upstanding barrel 20, which constantly carries the pressurized supply water. One end of the control water tube 70 is connected to the compression fitting 72 and the other end of the control water tube 70 is connected by a suitable fitting 74 to one end of an elbow-shaped pipe 76. The other end of the elbow 76 is connected to the inlet port 78 of a normally closed, solenoid operated control valve 80. The outlet port 82 of the solenoid operated control valve 80 is connected by way of a suitable fitting 84 to the control water inlet 46 of the actuator housing 44. The control valve 80 is opened only in response to appropriate control signals sent, via wires 86, to energize the solenoid portion therein. A suitable control valve is a 2.5 watt, 12 volt DC, 125 psi, Allied miniature Wattmizer, Model No. V2W393C-5, two-way solenoid valve, having a response time of 6–10 milliseconds.

Figure 5:
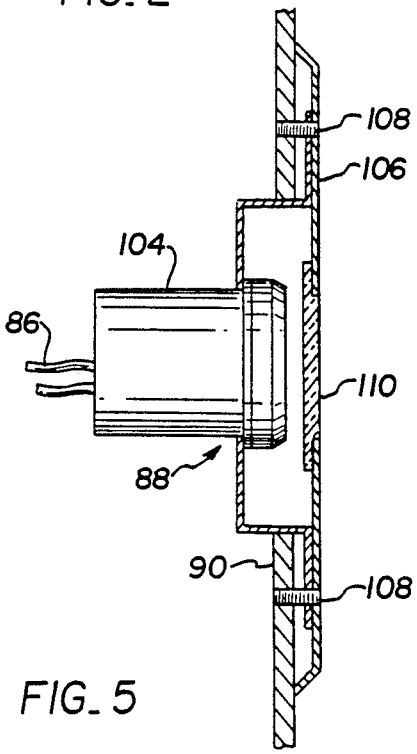
FIG. 5 is a section taken along lines V—V in FIG. 3.
Figure 6:
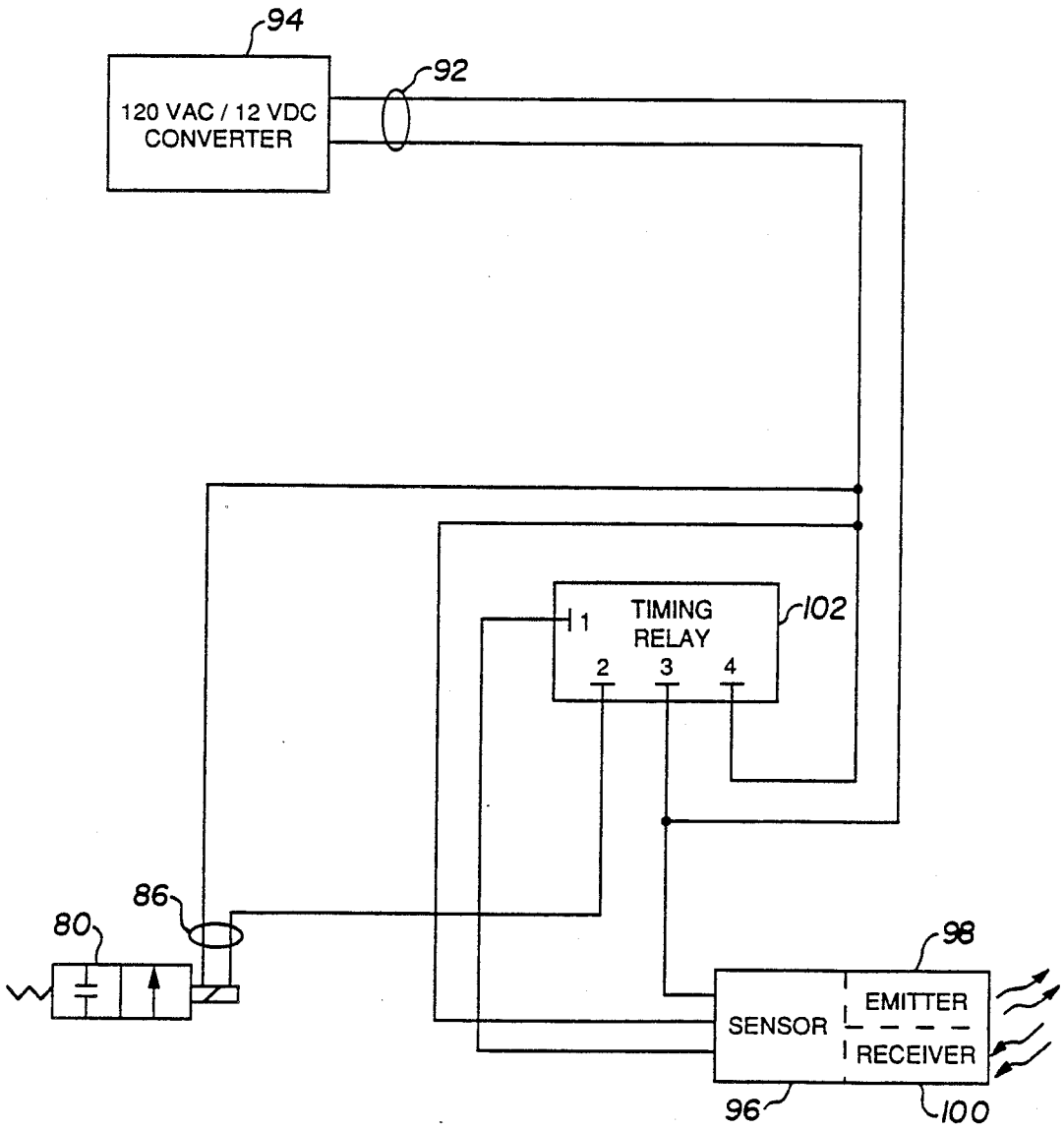
FIG. 6 is a schematic diagram of the solenoid control system shown in FIGS. 2 and 3.

Referring once again to FIGS. 1–5, as well as to FIG. 6, the sensor control elements of the present invention are shown. A sensor unit 88 is mounted to a wall 90 behind the plumbing fixture 6 in the vicinity of the flush valve 2. The sensor unit 88 can be supplied with appropriate electrical power via wires 92 from, for example, a plug-in AC adapter 94, such as a Model No. JK 1280, twelve volt DC output adapter sold by G.C. International, Inc. The sensor unit 88 includes an electromagnetic radiation emitting/detecting sensor 96, such as a Model No. SM 312D, Mini-Beam, diffuse scanning type, infrared sensor sold by Banner Engineering. As shown more clearly in FIG. 6, the sensor 96 includes a radiation emitting section 98 and a radiation detecting section 100. The radiation emitting section 98 sends out a continuous beam of infrared radiation. If a reflective surface, such as a person's hand, is positioned closely adjacent the sensor 96, the infrared radiation will be reflected back and detected by the receiver section 100. The sensitivity for the sensor 96 is preferably in the 3"–4" range so that only deliberate actions by a user will trip the unit. The sensor 96, as a result of radiation detected by the receiver section 100, will generate a first electrical control signal.

The first control signal is supplied to a timing relay 102 or the like which, in response thereto, generates a second electrical control signal having a predetermined duration. A suitable timing relay is a National Controls, Model No. Q2F-00005-326, solid state, single shot timing relay. The second control signal generated by the timing relay 102 is transmitted, via wires 86, to the solenoid actuated control valve 80. Electrical power for the control valve 80 is also carried via wires 86. It is preferred that the timing relay 102 include a power-up feature such that the timing relay 102 generates no control signals when power is initially supplied to the system.

Referring to FIG. 5, a typical construction of the wall mounted sensor unit 88 is shown. The sensor 96, which includes the radiation emitter 98 and radiation receiver 100, is typically packaged in a common housing 104 with the timing relay 102 and associated wiring. Wires 86 extend from the housing 104 to the control valve 80 and wires 92 (not shown in FIG. 5) extend from the AC adapter 94 to the housing 104. A wall bracket 106 carries the sensor unit 88 and its housing 104 and is mounted to the wall 90 by a plurality of fasteners 108. A protective cover 110, transparent to the infrared radiation of the sensor 96, is positioned in the middle of the wall bracket 106 above the optical elements of the sensor 96. This cover 110 both protects the sensor 96 from contacting damage, allows the emitted and reflected infrared radiation to pass therethrough, and provides a convenient target for activating the system.

Figure 2:
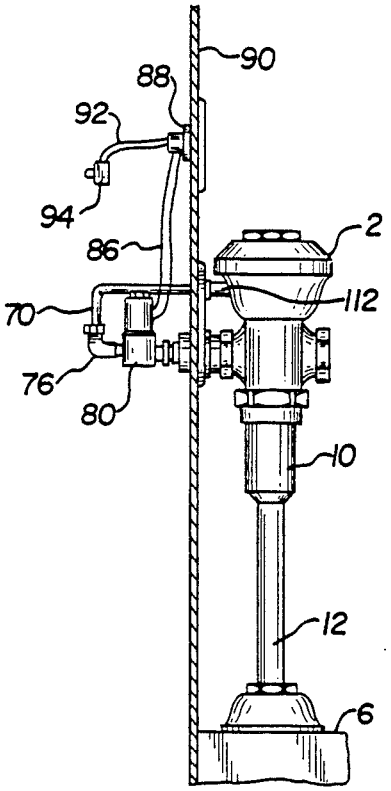
FIG. 2 is a side view of the arrangement shown in FIG. 1.
Figure 3:
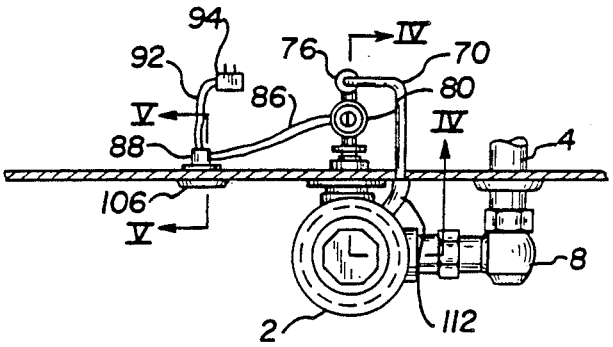
FIG. 3 is a top view of the arrangement shown in FIG. 1.

Referring to FIGS. 2 and 3, it is preferred that the sensor unit 88, the wires 86, 92 connected thereto and therefrom, the solenoid operated control valve 80 and the majority of the control water tube 70 from the flush valve 2, be positioned behind the wall 90 or other structure. In this manner, only the flat surface of the wall bracket 106 for the sensor unit 88 and the durable flush valve 2 are exposed to a user. This minimizes the opportunity for damage or other vandalism to the control system. That portion of the control water tube 70 in front of the wall 90 can be covered by a protective metal sleeve 112 or the like. In addition, it is preferred that the control water tube 70 extend perpendicularly to the wall 90 and flush valve 2 to minimize this exposed area. FIG. 3 shows the control water tube 70 extending from the valve body 14 at an angle only for purposes of clarity in the drawing.

The present system operates as follows: Initially, the diaphragm 22 is forced against the valve seat formed at the upper edge of the upstanding barrel 20 and prevents supply water from flowing through the valve 2. The pressurized supply water is also carried through the control water tube 70 to the inlet port 78 of the solenoid operated control valve 80. When a user positions a hand or the like over or near the sensor unit 88, reflected infrared radiation is received by the sensor 96. The sensor 96 then generates the first control signal which activates the timing relay 102. The timing relay 102 then generates the second control signal for a predetermined duration, such as for two seconds, which is supplied to and activates the control valve 80. The control valve 80 is now opened by its internal solenoid and permits the pressurized supply water to flow through the water inlet 46 and against the piston 48 within the actuator housing 44. This pressurized water will force the piston 58 inwardly against the force of the spring 60 which simultaneously moves the actuator rod 54 into contact with the stem 34 of the valve trip mechanism. The stem 34 will tilt and move the relief valve 32 away from the clamping disc 26 and cause the valve 2 to follow the flush cycle described above.

The control valve 80 will be activated for only a short duration, typically two seconds. Accordingly, the pressurized water supplied to the piston 58 will shortly be shut off, relieving the inwardly directed pressure against the piston 58. At that point, the force of the spring 60 will take over and push the piston 58 back to its original position near the water inlet 46 of the actuator housing 44 and draw the actuator rod 54 away from the trip mechanism. The bleed hole 68 through the piston 58 permits the water in the actuating chamber to slowly drain through the piston 58 as it is returned to its original position. Similarly, the drain holes 66 through the seal retainer 56 permit water between the piston 58 and the seal retainer 56 to be expelled therefrom when the piston 58 is moved inwardly by the force of the pressurized water.

Since the force of the pressurized water is used to move the piston 58, a large, powerful solenoid is not needed. The solenoid portion of the control valve 80 need only be large enough to operate a water valve therein. This provides for a much smaller and much less expensive arrangement.

Having described herein the presently preferred embodiment of the present invention, it is to be understood that the invention may be otherwise embodied within the scope of the appended claims.

We claim:

1. An on demand, non-contact sensor controlled flush alve actuation system comprising:

a flush valve controlling the flow of water between a pressurized water supply and a plumbing fixture, said flush valve including a trip mechanism therein;

an actuator assembly positioned within said flush valve and including a movable piston which is in fluid communication with a control water inlet therethrough;

a control water conduit having one end connected to said flush valve and in constant fluid communication with the pressurized supply water;

a normally closed solenoid operated control valve having an inlet port connected to the other end of said control water conduit and having an outlet port connected to said control water inlet of said actuator assembly;

a radiation generating and sensing unit which immediately generates a first control signal in response to the return reflection of electromagnetic radiation generated therein, said sensing unit having a low sensitivity range so that only deliberate actions of a user will cause the return reflection of said electromagnetic signal; and a timer which receives said first control signal and in response thereto immediately generates a second control signal of a predetermined duration, with said second control signal supplied to and activating said solenoid operated control valve, thereby opening said control valve and permitting a portion of said pressurized supply water to flow into said control water inlet and against said piston, with said piston moving from said pressurized supply water and moving said actuator assembly against the trip mechanism and opening the flush valve.

2. The on demand, non-contact sensor controlled flush valve actuation system of claim 1 wherein the radiation generating and sensing unit operates in the infrared radiation range.

3. The on demand, non-contact sensor controlled flush valve actuation system of claim 2 wherein said flush valve is a diaphragm operated flush valve.

4. The on demand, non-contact sensor controlled flush valve actuation system of claim 1 wherein said actuator assembly includes an actuator rod which is moved by said piston against said trip mechanism.

5. The on demand, non-contact sensor controlled flush valve actuation system of claim 4 wherein said piston and actuator rod are an integral unit.

6. The on demand, non-contact sensor controlled flush valve actuation system of claim 4 wherein said actuator rod is held by and moves within a seal retaining unit.

7. The on demand, non-contact sensor controlled flush valve actuation system of claim 6 wherein said seal retaining unit has at least one water drain hole therethrough.

8. The on demand, non-contact sensor controlled flush valve actuation system of claim 6 further including a spring surrounding said actuator rod and extending between said seal retaining unit and said piston.

9. The on demand, non-contact sensor controlled flush valve actuation system of claim 4 wherein said piston is cup-shaped, with an open portion of said piston directed toward said control water inlet.

10. The on demand, non-contact sensor controlled flush valve actuation system of claim 4 wherein said piston has at least one water bleed hole therethrough.

11. The on demand, non-contact sensor controlled flush valve actuation system of claim 1 wherein said predetermined duration is about 2 seconds.

12. The on demand, non-contact sensor controlled flush valve actuation system of claim 1 wherein said timer is a timing relay which includes a power-up feature such that no second control signal is generated when electrical power is first supplied to the system.

13. The on demand, non-contact sensor controlled flush actuation system of claim 1 wherein said sensitivity range is four inches or less.

14. The on demand, non-contact sensor controlled flush actuation system of claim 14 wherein said sensitivity range is between three inches and four inches.

15. The on demand, non-contact sensor controlled flush actuation system of claim 1 wherein said flush valve includes a body and said control water conduit is positioned external of said body having one end connected to said flush valve body.

16. An on demand, non-contact sensor controlled flush valve actuation system comprising:

a flush valve having a valve body controlling the flow of water between a pressurized water supply and a plumbing fixture, said flush valve including a trip mechanism therein;

an actuator assembly positioned within said flush valve and including a movable piston which is in fluid communication with a control water inlet therethrough;

a control water conduit positioned external of said body having one end connected to said flush valve body and in constant fluid communication with the pressurized supply water;

a normally closed solenoid operated control valve having an inlet port connected to the other end of said control water conduit and having an outlet port connected to said control water inlet of said actuator assembly;

a radiation generating and sensing unit which immediately generates a first control signal in response to the return reflection of electromagnetic radiation generated therein, said sensing unit having a sensitivity range of four inches or less, so that only deliberate actions of a use will cause the return reflection of said electromagnetic signal; and a timer which receives first control signal and in response thereto immediately generates a second control signal of a predetermined duration, with said second control signal supplied to and activating said solenoid operated control valve, thereby opening said control valve and permitting a portion of said pressurized supply water to flow into said control water inlet and against said piston, with said piston moving from said pressurized supply water and moving said actuator assembly against the trip mechanism and opening the flush valve.

17. The on demand, non-contact sensor controlled flush actuation system of claim 16 wherein said sensitivity range is between three inches and four inches.

18. The on demand, non-contact sensor controlled flush valve actuation system of claim 16 wherein the radiation generating and sensing unit operates in the infrared radiation range.

19. The on demand, non-contact sensor controlled flush valve actuation system of claim 16 wherein said predetermined duration is about 2 seconds.

20. The on demand, non-contact sensor controlled flush valve actuation system of claim 16 wherein said timer is a timing relay which includes a power-up feature such that no second control signal is generated when electrical power is first supplied to the system.

* * * * *

UNITED STATES PATENT AND TRADEMARK OFFICE

CERTIFICATE OF CORRECTION

PATENT NO. : 5,062,453

DATED : November 5, 1991

INVENTOR(S) : Robert E. Saadi, Allen R. Becker, Christopher J. Ball and John Steffan

It is certified that error appears in the above-identified patent and that said Letters Patent is hereby corrected as shown below:

On the title page:

Item [75]: after Inventors: "John" should read --Jon--.

Column 1 Line 40 "1,667,350" should read --4,667,350--.

Claim 1 Line 31 Column 6 "alve" should read --valve--.

Claim 14 Line 43 Column 7 "14" should read --13--.

Claim 16 Line 23 Column 8 "use" should read --user--.

Signed and Sealed this

Twenty-seventh Day of April, 1993

*Attest:*

MICHAEL K. KIRK

*Attesting Officer*

*Acting Commissioner of Patents and Trademarks*